US005739506A

United States Patent [19]

Hanton et al.

[11] Patent Number: 5,739,506

[45] Date of Patent: Apr. 14, 1998

[54] COIL POSITION ADJUSTMENT SYSTEM IN INDUCTION HEATING ASSEMBLY FOR METAL STRIP

[75] Inventors: David J. Hanton, Vienna; Nicholas V. Ross, Youngstown, both of Ohio

[73] Assignee: Ajax Magnethermic Corporation, Warren, Ohio

[21] Appl. No.: 700,271

[22] Filed: Aug. 20, 1996

[51] Int. Cl.[6] ..... H05B 6/10

[52] U.S. Cl. ..... 219/645; 219/650; 219/665; 219/675; 266/129; 148/568

[58] Field of Search ..... 219/645, 646, 219/635, 650, 663, 665, 670, 675, 676; 266/129, 90, 92; 148/567, 568

[56] References Cited

U.S. PATENT DOCUMENTS

| | | | |
|---|---|---|---|
| 2,871,940 | 2/1959 | Meunier | 219/645 |
| 3,313,907 | 4/1967 | Geisel et al. . | |
| 3,444,346 | 5/1969 | Russell et al. . | |
| 4,185,183 | 1/1980 | Kamimoto . | |
| 4,357,512 | 11/1982 | Nishimoto et al. . | |
| 4,405,386 | 9/1983 | Mravic et al. . | |
| 4,472,616 | 9/1984 | Maurice et al. . | |
| 4,584,746 | 4/1986 | Tivolle et al. | 29/81.08 |
| 4,585,916 | 4/1986 | Rich . | |
| 4,627,259 | 12/1986 | Andersson et al. . | |
| 4,678,883 | 7/1987 | Saitoh et al. | 219/645 |
| 4,751,360 | 6/1988 | Ross . | |
| 4,795,872 | 1/1989 | Hagisawa et al. . | |
| 4,891,484 | 1/1990 | Waggott et al. . | |
| 5,055,647 | 10/1991 | Heyes et al. | 219/645 |
| 5,156,683 | 10/1992 | Ross . | |
| 5,336,868 | 8/1994 | Schluckebier . | |
| 5,401,941 | 3/1995 | Mauve et al. . | |
| 5,403,994 | 4/1995 | Havas et al. . | |

*Primary Examiner*—Philip H. Leung

[57] ABSTRACT

An adjustable width transverse flux heating apparatus for induction heating in the moving workpiece includes first and second elements disposed in the common plane to form an inductive coil. The first and second conductor elements define a middle spacing in an internal cross-section area of the inductive coil. A monitor detects workpiece fractures and generates signals relating thereto. A motor system moves one of the conductor elements relative to the other in response to the signal generated by the workpiece monitor.

19 Claims, 1 Drawing Sheet

COIL POSITION ADJUSTMENT SYSTEM IN INDUCTION HEATING ASSEMBLY FOR METAL STRIP

BACKGROUND OF THE INVENTION

This application relates to transverse flux heating and more particularly to inductive heating of a continuously moving strip or sheet of metal. The invention is particularly applicable to systems wherein the moving sheet or strip contains edge deficiencies such as cracks. When applied, the invention adjusts heating currents applied to the moving sheet to prevent melting at the edge cracks.

Induction heating takes place when the steel sheet is placed in a varying magnetic field. The varying field induces electric currents within the steel sheet. Induction heating in the steel sheet results from hysteresis and eddy-current losses therein. The eddy-current losses near an edge crack of the metal sheet can be such that the resulting heat buildup may cause undesirable melting at the crack, which further deepens or widens the edge crack. A particular problem which has been encountered in installations that employ induction heating coils involves the occurrence of cracks or splits in the edge of the steel sheet. Without taking corrective action, the metal sheet could be severed at the crack during induction heating.

One solution is to reduce or completely interrupt the current to the inductive coil when the metal strip containing an edge crack enters into the inductive field. However, lower or total elimination of power to the inductor to prevent edge crack melting produces significant unheated areas within the metal sheet.

The subject invention comprises a new and improved transverse flux heating system which detects edge cracks prior to transverse flux heating. Upon detection, the system adjusts the width of the induction heating field to avoid heating edge cracks.

SUMMARY OF THE INVENTION

In accordance with the present invention there is provided an adjustable width transverse flux heating apparatus for induction heating of a moving workpiece. The heating apparatus includes first and second conductor elements disposed in a common plane but separately locatable to their individual positions by separate associated activating devices. The first and second conductor elements form an inductive coil and define a middle spacing in an internal cross-sectional area of the inductive coil. A first workpiece monitor detects fracture positions in the workpiece and generates first signals relating thereto. A first activating system controls the first conductor element position and moves the first conductor element relative to the second conductor element in response to signals generated by the first workpiece monitor.

In accordance with other features of the subject invention, the first activating system moves the first conductor relative to the second conductor when a detected workpiece discontinuity position becomes generally aligned with the inductive coil.

In accordance with yet another feature of the invention, the first conductor is moved relative to the second conductor to reduce the workpiece area that is heated so that there is no excessive heating of the detected fracture.

An important benefit of the subject invention is an automated heating apparatus which adjusts its position in response to detection of edge cracks in a moving workpiece.

A further benefit of the present invention is an adjustable transverse flux heating apparatus which easily and simply reduces the chance of workpiece fracture resulting from edge crack heating.

Other benefits and advantages of the subject new invention will become apparent to those skilled in the art upon reading and understanding of this specification.

BRIEF DESCRIPTION OF THE DRAWING

The invention may take physical form in certain parts and arrangements of parts, the preferred embodiment of which will be described in detail in this specification and illustrated in the accompanying drawing which forms a part hereof and wherein.

DETAILED DESCRIPTION OF THE INVENTION

Figure 1:
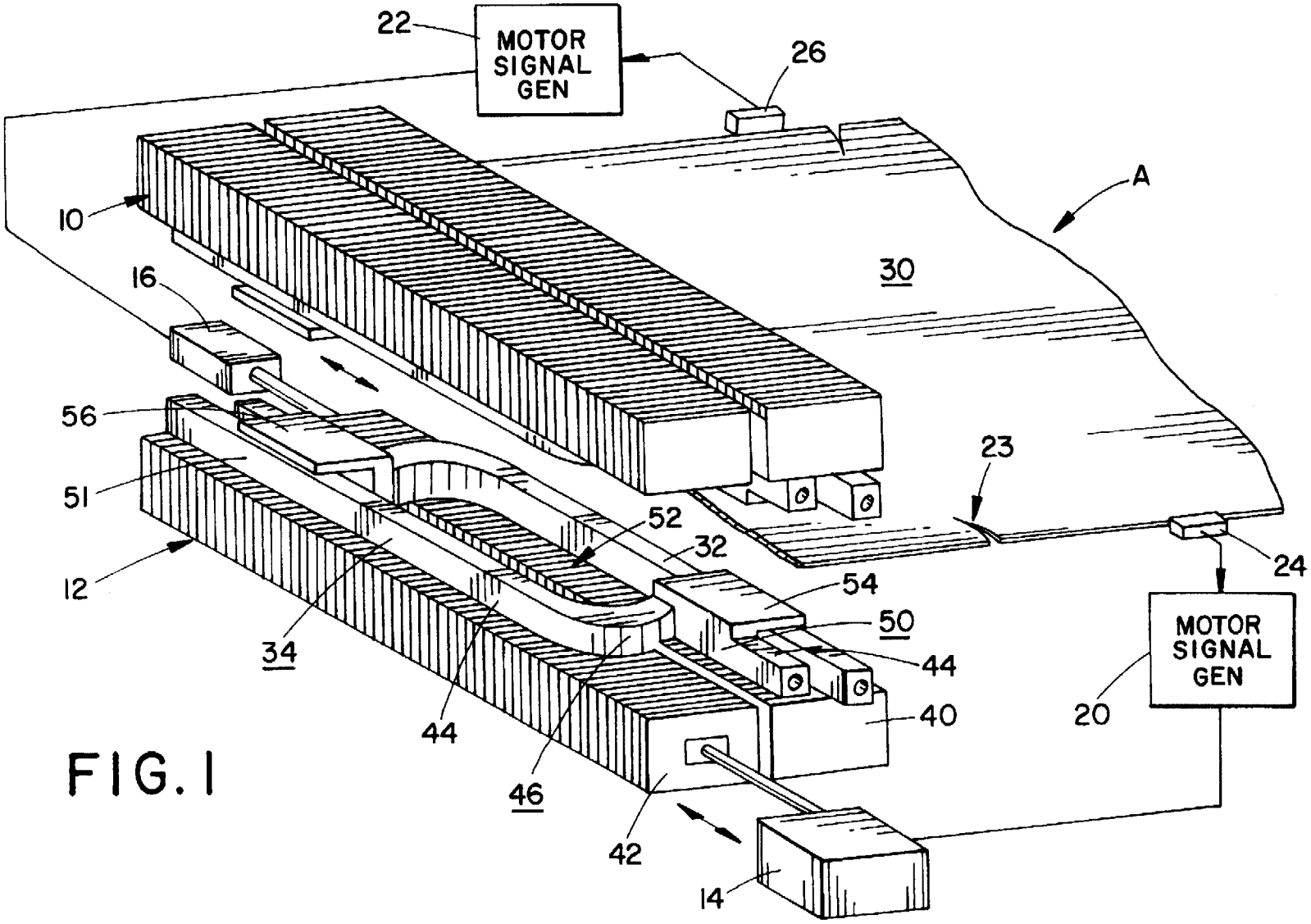
FIG. 1 is a schematic perspective view of the adjustable width flux heating apparatus formed in accordance with the present invention.

FIG. 1 is provided for the purpose of illustrating a preferred embodiment of the invention only, and not for limiting same. FIG. 1 shows an induction heating system for heating a metal strip 30 including a pair of opposed coil assemblies 10, 12, a pair of position adjustment devices 14, 16 for driving the coil assemblies, a pair of signal generators 20, 22 for detecting a discontinuity 23 in the edges of the strip, in electrical communication with the adjustment devices 14, 16, and a pair of workpiece monitors 24, 26 in communication with the signal generators 20, 22.

The pair of opposed coil assemblies 10, 12 are spaced to accommodate the moving metal sheet 30 that passes between them for inductive heating. Coil assembly 12 comprises a first J-shaped conductor 32, a second J-shaped conductor 34, a first flux guide 40, and a second flux guide 42.

The J-shaped conductors 32, 34 are disposed adjacent to each other to form an inductive coil relative to the metal sheet moving in the direction of arrow A. The J-shaped conductors are usually mirror images of one another. Each J-shaped conductor has a relatively straight section 44, a curved section 46 and a straight terminal end portion 50. The oppositely facing J configuration of the conductors results in the formation of a middle spacing 52 formed within the perimeter of an internal cross-sectional area of the coil defined by the two Js. Accordingly, the magnetic flux lines can pass about the conductors 32, 34 in a transverse direction relative to the sheet moving therebetween.

Conductors 32, 34 include flag or tab portions 54, 56 at the terminal end portions 50 of each J conductor. The tabs 54, 56 essentially comprise a cover shield which forms a flux shield between the conductors. The tabs 54, 56 are planar configured to provide a substantially extensive cross-sectional area which can shield flux lines passing between the straight terminal end portion 50 of the conductor and the opposite terminal end portion 51 at the curved portion 46 from the side ends of the strip 30. The close proximity of the straight section 44 and terminal end portion 50 was found to create relatively intense magnetic flux lines passing therebetween, which would cause undesirable edge heating in the strip 30. To better control the edge heating properties of the system, the tab portions 54, 56 obstruct the lines so that the system can more readily accomplish its goal of uniform sheet heating.

Coil assemblies 10, 12 further includes flux guides 60, 62 disposed on a single side of the conductors, that is, on the side of the conductor which is opposite the side facing the sheet 30. The other three sides of each conductor are exposed to allow a relative free translation of each conductor to the other in a direction parallel to the sheet width. In other words, conductor 32 can freely move relative to the conductor 34 by merely sliding each relative to the other and thereby increasing or decreasing the middle spacing 52. A conventional frame (not show) supports the coil assemblies so that the conductors 32, 34 are quickly and easily translated in accordance with movement controls from the adjustment devices 14, 16.

The arrangement of FIG. 1 allows for a fully adjustable system without obstructing the middle spacing 52 with flex guide portions. This allows for automatic adjustment of the middle spacing to accommodate detected edge cracks in the moving workpiece as will be more fully explained below. The ease in adjustment can be readily appreciated.

Workpiece monitors 24 and 26 are disposed adjacent the edges of moving workpiece 30. These monitors continuously monitor the moving workpiece 30 for edge cracks and generate signals upon detection thereof. The edge cracks are deformities or discontinuations 23 including but not limited to simple splits in the edge. When cracks are detected workpiece monitors 24 or 26 generate signals which are subsequently used to reduce the middle spacing 52 prior to the cracks entering the inductive field produced by the coils. The monitors may comprise a U-shaped device around the strip edge or two separate devices over and under the strip edge.

Signal generators 20 and 22 process signals generated by the workpiece monitors along with a signal representative of the workpiece speed. These signals are processed to generate signals which enable position adjustment devices 14 or 16 to adjust the middle spacing 52 of each coil. The devices 14, 16 can comprise conventional motors, a piston and cylinder assembly, or other activating systems. It is of primary importance that they can effectively and efficiently control coil position in response to the signal from the signal generators. For simplicity, they will be referred to as a "motor" hereafter.

Description will be made with respect to signal generator 20, it being understood that generator 22 operates similarly. Signal generator 20 calculates the time $T_1$ for a detected crack to travel between the monitor position and a position just outside of alignment with the middle spacing 52. Upon passage of time $T_1$, the signal generator produces a first signal enabling the motor 14 to adjust coil position so the heating of the detected crack can be effectively reduced. The signal generator also calculates time $T_2$, the time needed for the detected crack to travel through the area aligned with middle spacing 52. Upon passage of time $T_1$ and $T_2$, the signal generator produces a second signal enabling motor 14 so that the coil can be returned to its original position.

Motors 14 and 16 are either operatively fastened to first and second flux guides 40 and 42 which in turn engage the first and second J-shaped conductors 32 and 34, or directly connected to the conductors themselves. The motors 14 and 16 in operation engage the flux guides and create relative translation of one flux guide with respect to the other. Description will be made with respect to motor 14, it being understood that motor 16 operates similarly. When motor 14 receives the first signal generated by motor signal generator 20, motor 14 moves flux guide 40 to reduce the middle spacing 52 formed by the internal cross-sectional area of the two conductors 32, 34. This action occurs before the correspondingly detected edge crack 23 enters the inductive field space aligned with the middle spacing 52. Because the middle spacing is reduced when the edge crack is aligned thereto, the inductive field used to heat the workpiece is likewise reduced. As a result, the metal area around the detected workpiece crack is not subjected to direct inductive heating. When motor 14 receives the second signal, motor 14 moves flux guide 40 back to its original position after the edge crack 23 moves out range from direct heating by the coil assemblies 10, 12.

The basic advantage in using the induction heating of the present invention is the ability to automatically adjust the workpiece heating pattern to avoid melting the metal area immediately around a detected workpiece edge crack.

The invention has been described with reference to the preferred embodiments. Modifications and alterations will obviously appear to others upon reading and understanding of the specification. It is the intention of the inventors to include all such modifications and alterations as part of this invention to the extent that they come within the scope of the appended claims.

Having thus described the invention, it is now claimed:

1. An adjustable width transverse flux heating apparatus for induction heating of a moving workpiece comprising:

first and second conductor elements disposed in a first relative position in a common plane to comprise an inductive coil and define a middle spacing in an internal cross-sectional area of the inductive coil;

a first workpiece monitor for detecting workpiece fracture positions in the moving workpiece and generating first signals representative of the fracture positions; and a first position adjustment device for engaging the first conductor element for moving the first conductor element relative to the second conductor element to a second relative position in response to the first signals generated by the first workpiece monitor, without adjustment of the moving of the workpiece for varying the heating of the workpiece at the fracture positions.

2. The heating apparatus of claim 1 further comprising:

a second workpiece monitor for detecting workpiece fracture positions and generating second signals relating thereto; and a second position adjustment device for engaging the second conductor element for moving the second conductor element relative to the first conductor element in response to the second signals generated by the second workpiece monitor.

3. The heating apparatus of claim 2 wherein the second workpiece monitor detects fracture positions along a second edge of the workpiece.

4. The heating apparatus of claim 1 wherein the first workpiece monitor detects fracture positions along a first edge of the workpiece.

5. The heating apparatus of claim 1 wherein the first and second conductor elements are J-shaped.

6. The heating apparatus of claim 1 wherein the first position adjustment device moves the first conductor relative to the second conductor thereby reducing the internal cross sectional area of the inductive coil.

7. The heating apparatus of claim 1 wherein the first position adjustment device moves the first conductor relative to the second conductor when a detected workpiece fracture position becomes generally aligned with the inductive coil.

8. The apparatus of claim 1 wherein the first position adjustment device further includes a signal processor which generates first conductor movement signals as a function of the first signals generated by the first workpiece monitor.

9. The apparatus of claim 1 wherein the first conductor is moved from the first relative position to the second relative position to reduce workpiece area in which induction heating is effected.

10. An adjustable width flux heating apparatus for induction heating a moving workpiece, comprising:

first and second conductor elements disposed in a common plane, the first and second conductor elements comprising an inductive coil and defining a middle spacing in an internal cross sectional area of the inductive coil;

means for supplying an electric current to each of the first and second conductor elements to create a magnetic field for induction heating a workpiece area adjacent the inductive coil;

means for monitoring the moving workpiece to detect fracture positions at edge portions thereof; and means, connected to the monitoring means, for adjusting the internal cross sectional area of the inductive coil in response to a fracture position detected by the monitoring means for selectively adjusting the heating of the workpiece at the fracture positions to preserve a desired heating in the workpiece.

11. The apparatus of claim 10 wherein the internal cross sectional area is adjusted by translating one of the first and second conductor elements relative to the other.

12. The apparatus of claim 10 wherein the internal cross sectional area is reduced as the detected fracture position becomes generally aligned with the inductive coil.

13. The apparatus of claim 10 wherein the means for adjusting further comprises:

first and second movable guides connected to the first and second conductor elements respectively for selectively guiding a translation of the first and second conductor elements with respect to each other in a common plane; and a first movable guide actuating system engaging the first movable guide, for moving the first movable guide relative to the second movable guide in response to a detected fracture position in the workpiece.

14. The apparatus of claim 10 wherein the first and second conductor elements are J-shaped.

15. The heating apparatus of claim 10 wherein the monitor means detects a depth of a workpiece fracture.

16. A method for induction heating a workpiece, comprising:

moving a workpiece over first and second conductor elements disposed in a common plane, the first and second conductor elements comprising an inductive coil and defining a middle spacing in an internal cross-sectional area of the inductive coil;

supplying an electric current to each of the first and second conductor elements to create a magnetic field for induction heating a workpiece area adjacent the inductive coil;

monitoring an edge of the moving workpiece to detect a position of a fracture at an edge portion therein; and adjusting the internal cross sectional area of the inductive coil when the detected fracture position becomes aligned with the inductive coil, while maintaining the moving of the workpiece for selectively adjusting the heating of the workpiece to preserve the workpiece while protecting against overheating of the edge portion.

17. The method of claim 16 wherein the internal cross sectional area is adjusted by translating one of the first and second conductor elements relative to the other.

18. The method of claim 16 wherein the internal cross sectional area is reduced as the detected fracture position becomes aligned with the inductive coil.

19. The method of claim 16 further comprising the steps of:

generating a signal representing the position of the detected fracture;

generating a signal representing a speed at which the workpiece moves with respect to the inductive coil; and processing the detected fracture position and workpiece speed signals to generate an adjustment signal wherein the internal cross sectional area of the inductive coil is adjusted in response to the adjustment signal.

* * * * *